US010440480B2

(12) United States Patent
Butts et al.

(10) Patent No.: US 10,440,480 B2
(45) Date of Patent: Oct. 8, 2019

(54) HYBRID ACTIVE NOISE CONTROL

(71) Applicant: Harman International Industries, Incorporated, Stamford, CT (US)

(72) Inventors: Donald Joseph Butts, Westport, CT (US); Todd Suko, Stamford, CT (US)

(73) Assignee: HARMAN INTERNATIONAL INDUSTRIES, INCORPORATED, Stamford, CT (US)

( * ) Notice: Subject to any disclaimer, the term of this patent is extended or adjusted under 35 U.S.C. 154(b) by 438 days.

(21) Appl. No.: 15/092,568

(22) Filed: Apr. 6, 2016

(65) Prior Publication Data

US 2017/0301338 A1 Oct. 19, 2017

(51) Int. Cl.
*G10K 11/178* (2006.01)
*H04R 17/02* (2006.01)
(Continued)

(52) U.S. Cl.
CPC ..... *H04R 17/02* (2013.01); *G10K 11/178* (2013.01); *H04R 1/403* (2013.01); *H04R 1/406* (2013.01); *H04R 3/005* (2013.01); *H04R 3/12* (2013.01); *G10K 2210/12* (2013.01); *G10K 2210/1281* (2013.01); *G10K 2210/1282* (2013.01); *G10K 2210/1283* (2013.01);
(Continued)

(58) Field of Classification Search
CPC ..... G10K 11/1786; G10K 2210/1282; G10K 11/175; G10K 2210/128; G10K 2210/3014; G10K 2210/3221; H04R 17/00; H04R 2410/05; G10L 21/0208
USPC ..... 381/71.1, 71.4, 71.8, 71.11
See application file for complete search history.

(56) References Cited

U.S. PATENT DOCUMENTS 4,977,600 A 12/1990 Ziegler
2007/0297620 A1* 12/2007 Choy ..... G10K 11/178 381/73.1
(Continued)

FOREIGN PATENT DOCUMENTS

GB 2310512 A 8/1997

OTHER PUBLICATIONS

Elliott, Stephen J. et al., "Interaction Between Mulitple Feedforward Active Control Systems", IEEE Transactions on Speech and Audio Processing, IEEE Service Center, New York, NY, US, vol. 2, No. 4, Oct. 1, 1994, pp. 521-530.
(Continued)

*Primary Examiner* — George C Monikang
(74) *Attorney, Agent, or Firm* — Artegis Law Group, LLP

(57) ABSTRACT

A technique for reducing noise in a listening environment. The technique includes dividing the listening environment into a plurality of zones, where each zone is associated with a different active noise cancellation (ANC) system. A boundary between a first zone included in the plurality of zones and a second zone included in the plurality of zones comprises open space. The technique further includes assigning a plurality of acoustic sensors and a plurality of speakers to the ANC system associated with each zone included in the plurality of zones. The technique further includes, for each zone included in the plurality of zones, acquiring acoustic data via the plurality of acoustic sensors, processing the acoustic data, via a processor, to generate noise cancellation signals, and outputting the noise cancellation signals via the plurality of speakers.

21 Claims, 6 Drawing Sheets

(51) Int. Cl.

| | |
|---|---|
| ***H04R 1/40*** | (2006.01) |
| ***H04R 3/00*** | (2006.01) |
| ***H04R 3/12*** | (2006.01) |

(52) U.S. Cl.

CPC ..... *G10K 2210/3028* (2013.01); *G10K 2210/3044* (2013.01); *G10K 2210/3046* (2013.01); *H04R 2499/13* (2013.01)

(56) References Cited

U.S. PATENT DOCUMENTS

| | | | | |
|---|---|---|---|---|
| 2008/0019536 | A1* | 1/2008 | Marrot | G10K 11/178<br>381/71.4 |
| 2010/0104110 | A1 | 4/2010 | Asao et al. | |
| 2010/0290635 | A1* | 11/2010 | Shridhar | G10K 11/178<br>381/71.1 |
| 2010/0329471 | A1* | 12/2010 | Dunn | H03G 3/32<br>381/57 |
| 2010/0329488 | A1* | 12/2010 | Holub | H04R 27/00<br>381/301 |

OTHER PUBLICATIONS

Extended European Search Report for EP Application No. 17164748.0 dated Aug. 21, 2017, 11 pages.

* cited by examiner

HYBRID ACTIVE NOISE CONTROL

BACKGROUND

Field of the Embodiments

The various embodiments relate generally to audio signal processing and, more specifically, to techniques for hybrid active noise control (ANC).

Description of the Related Art

Many techniques have been developed for eliminating unwanted noise in various environments. In one such technique, known as active noise cancellation (ANC), noise in the surrounding environment is detected via one or more microphones. Inverses of one or more waveforms associated with the noise are then generated and reproduced via one or more speakers in order to destructively interfere with or "cancel out" the noise. Such techniques are employed in a wide range of devices, including ANC headphones and hearing aid devices, providing users with greater control over their auditory environments.

Recently, ANC systems have begun to be integrated into larger systems, such as automobiles. In particular, in automotive applications, multiple microphones are distributed throughout the vehicle and passenger compartment, and acoustic data acquired via the microphones are transmitted to a centralized control unit. The centralized control unit then generates noise cancellation signals, which are reproduced by speakers within the passenger compartment of the vehicle to cancel out the vehicle and road noise detected by the microphones.

Although ANC techniques are relatively effective in reducing unwanted noise in relatively smaller environments, such as within automobiles, these techniques are less effective at reducing noise in larger environments and at higher frequencies. In particular, increasing the acoustic volume results in an exponential increase in the modal density within the environment. The corresponding large number of participating acoustic modes typically requires that the number of speakers be at least equal to the number of relevant acoustic modes. For example, and without limitation, the number of acoustic modes as a function of frequency (Hz) for a helicopter cabin is shown in FIG. 6. Because of the increased modal density within the environment, generating noise cancellation signals within that environment via a centralized control unit, as described above, becomes prohibitively complex.

In order to address these issues in large listening environments, some conventional approaches implement a fully decentralized ANC system having multiple control units, where each control unit operates independently of the other control units. In particular, to gain control authority in such decentralized ANC systems, a different control unit typically is required for each participating acoustic mode within the listening environment. In view of this constraint as well as the increased modal densities in larger listening environments, decentralized ANC system implementations in larger listening environments usually have significant hardware requirements, making such systems cost-prohibitive in such environments. Further, the weight associated with decentralized ANC systems makes these systems impractical for use in transportation-oriented environments, such as in aircraft and automobiles.

As the foregoing illustrates, more effective techniques for performing active noise cancellation in various types of listening environments would be useful.

SUMMARY

Embodiments of the present disclosure set forth a method for reducing noise in a listening environment. The method includes dividing the listening environment into a plurality of zones, where each zone is associated with a different active noise cancellation (ANC) system. A boundary between a first zone included in the plurality of zones and a second zone included in the plurality of zones comprises open space. The method further includes assigning a plurality of acoustic sensors and a plurality of speakers to the ANC system associated with each zone included in the plurality of zones. The method further includes, for each zone included in the plurality of zones, acquiring acoustic data via the plurality of acoustic sensors, processing the acoustic data, via a processor, to generate noise cancellation signals, and outputting the noise cancellation signals via the plurality of speakers.

Further embodiments provide, among other things, a system and a vehicle configured to implement aspects of the method set forth above.

Advantageously, the disclosed techniques enable sound to be more effectively cancelled within large listening environments, such as large passenger compartments. Further, due to the synergistic effect of combining a centralized ANC approach and a decentralized ANC approach, effective noise cancellation can be achieved with lower hardware requirements. Accordingly, the disclosed techniques are more cost-effective and are capable of being implemented in applications where weight is an important consideration.

BRIEF DESCRIPTION OF THE SEVERAL VIEWS OF THE DRAWINGS

So that the manner in which the recited features of the one or more embodiments set forth above can be understood in detail, a more particular description of the one or more embodiments, briefly summarized above, may be had by reference to certain specific embodiments, some of which are illustrated in the appended drawings. It is to be noted, however, that the appended drawings illustrate only typical embodiments and are therefore not to be considered limiting of its scope in any manner, for the scope of the various embodiments subsumes other embodiments as well.

DETAILED DESCRIPTION

In the following description, numerous specific details are set forth to provide a more thorough understanding of the embodiments of the present disclosure. However, it will be apparent to one of skill in the art that the embodiments of the present disclosure may be practiced without one or more of these specific details.

System Overview

Figure 1:
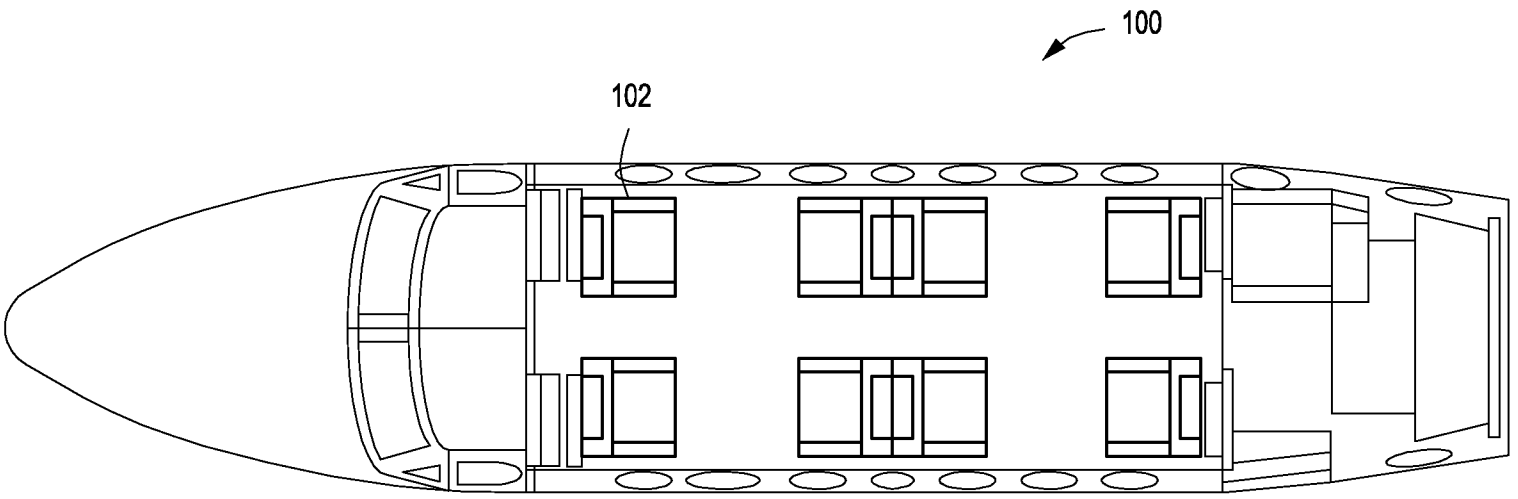
FIG. 1 illustrates a passenger compartment of an aircraft, according to various embodiments.

FIG. 1 illustrates a passenger compartment 100 of an aircraft, according to various embodiments. As shown, the passenger compartment 100 may include one or more passenger seats 102.

The frequency response of a listening environment depends upon a variety of factors, including the dimensions, orientations, and material composition of the boundaries of the listening environment. In particular, the dimensions of a listening environment influence the number of acoustic modes that can be excited by a noise source.

In many situations, it is desirable to reduce unwanted noise within a listening environment. For example, and without limitation, in many transportation applications, vibrations resulting from engine operation, rough terrain, airflow, propeller noise, etc. produce noise within a passenger compartment of a vehicle (e.g., an automobile, a watercraft, an aircraft, a spacecraft, a railway vehicle). When implementing noise cancellation techniques in such environments, the number of acoustic sensors and speakers required to effectively reduce noise is based on the number of modes within the environment which, as discussed above, is based on the dimensions of the environment. Consequently, in a relatively small passenger compartment, such as within a small automobile, noise cancellation can be performed with relatively modest hardware requirements.

However, when the dimensions of a listening environment are increased, the resulting increase in the number and modal density significantly reduces the effectiveness of conventional active noise cancellation (ANC) techniques. Specifically, conventional ANC systems that are operated via a centralized controller generally are unable to effectively cancel noise in complex environments having a high modal density, rendering such systems ineffective in large listening environments. Further, although decentralized ANC systems are more effective at cancelling noise in large listening environments, such systems typically require a separate control unit, acoustic sensor, and speaker for each acoustic mode included in the desired noise cancellation frequency range. As a result, the cost and weight of the hardware required for decentralized systems prevents these systems from being implemented in many large-scale applications, such as in a passenger compartment of an aircraft, a bus, a train car, etc. Thus, conventional ANC systems suffer from many shortcomings in reducing unwanted noise in large listening environments.

Accordingly, in various embodiments, a hybrid ANC system may be implemented in a listening environment (e.g., a passenger compartment) by dividing the listening environment into multiple zones, where each zone includes multiple acoustic modes and is associated with a different "centralized" (with respect to the zone) ANC system. Advantageously, by dividing the passenger compartment into multiple zones and managing the acoustic modes in each zone via an independent ANC system, hardware requirements are reduced relative to conventional decentralized ANC techniques, which generally require a separate controller, acoustic sensor, and speaker per acoustic mode. Additionally, because each ANC system included in each zone of the hybrid ANC system is responsible for managing a smaller number of acoustic modes, processing complexity is significantly reduced, enabling the hybrid ANC system to obtain control authority more effectively than conventional centralized ANC systems having a similar total number of acoustic sensors and speakers. That is, due to the synergistic effect of combining a centralized ANC approach and a decentralized ANC approach within a single listening environment, noise is more effectively reduced both per zone and within the listening environment as a whole relative to a conventional ANC system that implements an equal number of acoustic sensors and speakers. Various embodiments of the hybrid ANC system are described below in further detail in conjunction with FIGS. 2-5.

Figure 2:
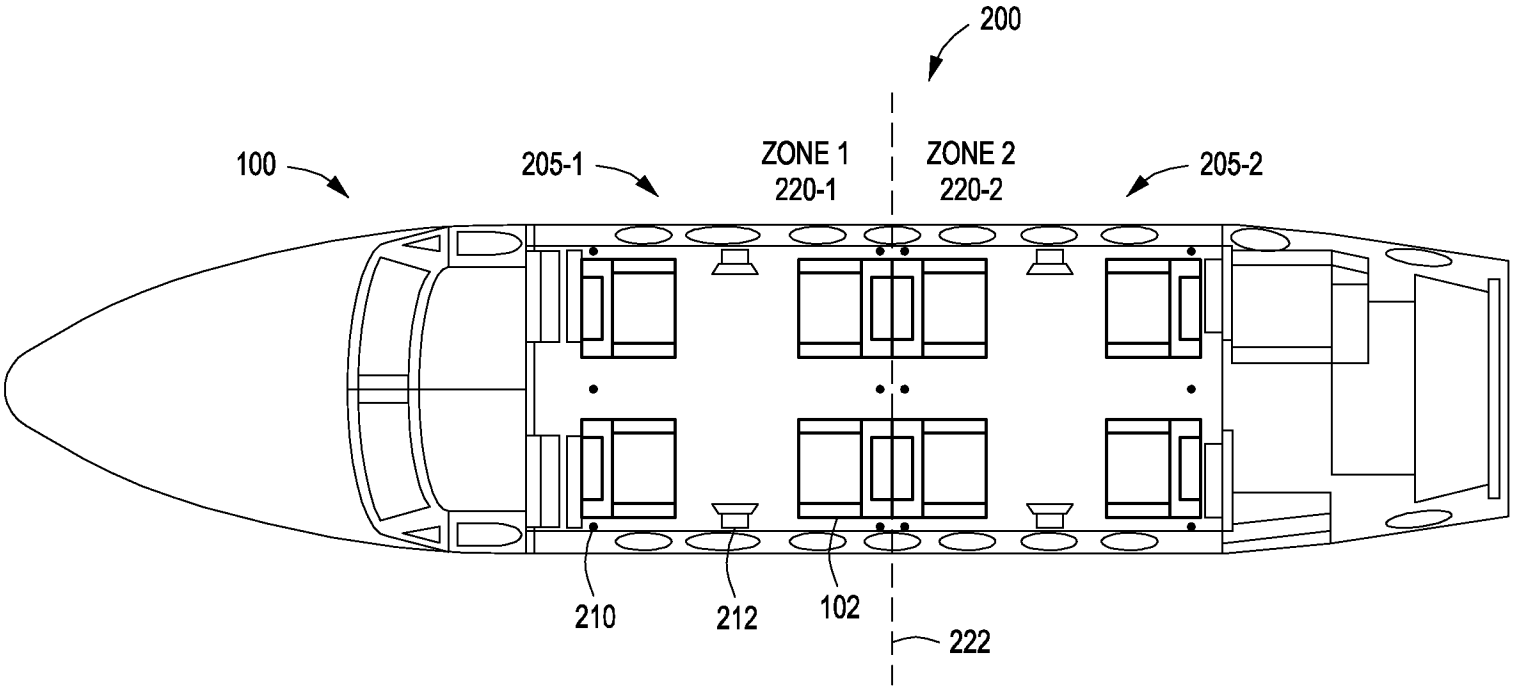
FIG. 2 illustrates a hybrid ANC system implemented in the passenger compartment of FIG. 1, according to various embodiments.

FIG. 2 illustrates a hybrid ANC system 200 implemented in the passenger compartment 100 of FIG. 1, according to various embodiments. As shown, the hybrid ANC system 200 includes a first ANC system 205-1 in a first zone 220-1 of the passenger compartment 100 and a second ANC system 205-2 in a second zone 220-2 of the passenger compartment 100. Each of the first ANC system 205-1 and the second ANC system 205-2 includes acoustic sensors 210 and speakers 212.

The acoustic sensors 210 —commonly referred to as error microphones —included in each ANC system 205 are configured to acquire acoustic data (e.g., noise) from the surrounding environment and transmit signals associated with the acoustic data to a computing device associated with the ANC system 205. The acoustic data acquired by the acoustic sensors 210 is then processed by the computing device to determine and/or adjust the noise cancellation signals being produced by the speakers 212. In various embodiments, the acoustic sensors 210 may include any type of transducer capable of acquiring acoustic data including, for example and without limitation, a differential microphone, a piezoelectric microphone, an optical microphone, etc. In some embodiments, the hybrid ANC system 200 further includes a reference sensor located outside of the passenger compartment 100, such as near the nose of an aircraft, in order to provide a reference signal to the hybrid ANC system 200.

In general, the acoustic sensors 210 may be positioned at any location within a zone 220 of the passenger compartment 100. In some embodiments, acoustic sensors 210 are located on or proximate to the walls and/or ceiling of the zone 220 of the passenger compartment 100. For example, and without limitation, the acoustic sensors 210 could be positioned on or proximate to the skin of an aircraft in order to sense external noise (e.g., engine noise, wind noise, etc.) that is coupled to the passenger compartment via the skin of the aircraft. Further, in some embodiments, the acoustic sensors 210 are positioned proximate to the ears of passengers within the zone 220 in order to more accurately measure noises as perceived by the passengers.

The speakers 212 are configured to produce sounds (e.g., inverse waveforms) to cancel noise within a zone 220 of the passenger compartment 100 based on noise cancellation signals received from a computing device associated with the zone 220. For example, and without limitation, as shown in FIG. 2, two or more speakers 212 could be positioned in each zone 220 in order to cancel noise within a certain frequency range (e.g., approximately 100 Hz to approximately 300 Hz) present in that zone 220. For example, and without limitation, each ANC system 205 could cancel noise (e.g., engine noise, propeller noise, etc.) having frequencies of approximately 100 Hz, approximately 200 Hz, and approximately 300 Hz. In some embodiments, the speakers 212 are positioned within and/or proximate to the interior walls of an aircraft. For example, and without limitation, the speakers 212 could be positioned in the headliner of an aircraft and/or located above the passenger seats 102.

In some embodiments, the ANC system 205 associated with each zone 220 may include a speaker 212 for each passenger seat 102 located within the zone 220. For example, with reference to zone 220-1, ANC system 205-1 could include four speakers 212, each of which is positioned proximate to a different passenger seat 102 included in the zone 220-1. Notably, however, due to the aforementioned synergistic effect of combining the centralized ANC approach and the decentralized ANC approach, the hybrid ANC system 200 disclosed herein is able to obtain control authority over noise having a frequency range of approximately 100 Hz to approximately 300 Hz using only two speakers 212 per zone 220, where each zone 220 has dimensions of approximately 6 feet×4 feet×5 feet (length×width×height). Accordingly, although only two speakers 212 are shown in each zone 220 of FIG. 2, in other embodiments, additional speakers 212 may be implemented, for example, and without limitation, based on the dimensions of the passenger compartment 100 and the frequency range to be cancelled by the hybrid ANC system 200.

Various techniques may be used to determine the size of each zone. In some embodiments, sound measurements inside the passenger compartment 100 are acquired via a twelve-microphone array (e.g., a 3×4 array) first positioned in zone 220-i and then in zone 220-2. For example, and without limitation, the array of microphones could be positioned such that three testing microphones are positioned across the passenger compartment 100 at four axial locations along the passenger compartment 100. Then, a singular value decomposition (SVD) technique was used to determine the size of each zone 220 and to determine how many speakers 212 would be needed to cancel noise though the area represented by the position of the planar microphone array.

For example, and without limitation, a SVD technique could be applied to the complex pressure amplitudes determined by performing a complex Fourier transform on the time signals acquired at each testing microphone for the fundamental and harmonics frequencies of the propeller (e.g., 100 Hz, 200 Hz, and 300 Hz). Thus, the SVD process could be implemented to decompose the pattern of data represented by the total pressure amplitude across the array of testing microphones into a set of orthogonal components (e.g., the principal components), each of which is associated with a singular value. These orthogonal components correspond to a partial sampling of the acoustic modal contributions within the passenger compartment 100 across the array testing microphones. In some embodiments, the singular values are determined based on the geometry of the three testing microphones across each axial location of the passenger compartment 100. The SVD results for the passenger compartment 100 shown in FIG. 2 indicated that there are two significant singular values at the first harmonic, indicating that global control at these frequencies could be achieved across the area occupied by the array of testing microphones using two speakers 212 and two microphones 210. The response across the array of testing microphones appeared to be due to two independent acoustic modes within the passenger cabin 100.

In some embodiments, the speakers 212 are configured for high-fidelity sound reproduction. In other embodiments, in order to reduce the size, weight, and/or cost of the speakers 212, the speakers 212 may be configured for less accurate sound reproduction. For example, and without limitation, the speakers 212 could be configured to produce only a subset of frequencies within the normal human hearing range, such as a set of frequencies intended to be cancelled by the hybrid ANC system 200. In general, however, any device capable of producing inverse waveforms to cancel sound may be implemented with the hybrid ANC system 200.

Figure 3:
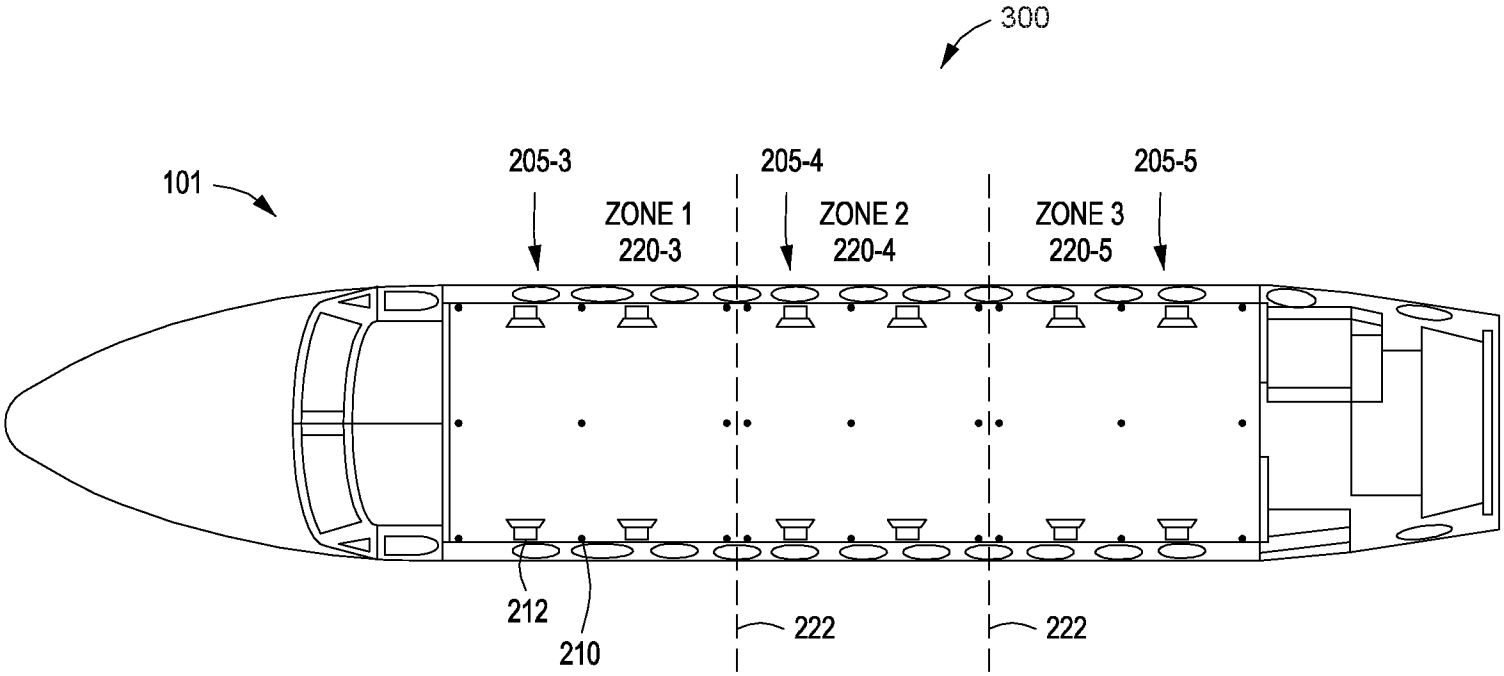
FIG. 3 illustrates a hybrid ANC system implemented in a passenger compartment of an aircraft having three different zones, according to various embodiments.

In various embodiments, the passenger compartment 100 includes an aircraft cabin, as shown in FIGS. 1-3. However, the hybrid ANC system 200 may be implemented to improve the performance of noise cancellation techniques in any type of listening environment. For example, and without limitation, the hybrid ANC system 200 could be implemented within a vehicle, such as a train, a bus, an automobile, etc. or within a building, such as an office, a machine room, a bedroom, etc.

FIG. 3 illustrates a hybrid. ANC system 300 implemented in a passenger compartment 101 of an aircraft having three different zones 220, according to various embodiments. As shown, the hybrid ANC system 300 includes a first ANC system 205-3 in a first zone 220-3 of the passenger compartment 101, a second ANC system 205-4 in a second zone 220-4 of the passenger compartment 101, and a third ANC system 205-5 in a third zone 220-5 of the passenger compartment 101. Each of the first ANC system 205-3, the second ANC system 205-4, and the third ANC system 205-5 includes acoustic sensors 210 and speakers 212 substantially similar to those discussed above with respect to FIG. 2.

As shown, in a larger listening environment, such as a passenger compartment 101 of a larger aircraft, one or more additional zones 220 may be implemented in order to accommodate the larger modal density. Further, in some embodiments, additional acoustic sensors 210 and/or speakers 212 may be implemented within each of the zones 220. For example, and without limitation, nine or more acoustic sensors 210 and four or more speakers 212 could be implemented in each zone 220 of the passenger compartment 101. For purposes of clarity, no passenger seats 102 are shown in FIG. 3. However, in various embodiments, the acoustic sensors 210 and speakers 212 shown in FIG. 3 may be positioned at similar locations as shown in FIG. 2 relative to passenger seats, walls, ceilings, etc. included in the passenger compartment 101.

In addition, although the three zones 220 shown in FIG. 3 are located in a linear configuration relative to one another, in some embodiments, passenger compartment 100 and/or passenger compartment 101 may include zones 220 configured in an M×N grid, where both M and N are greater than one. For example, and without limitation, a listening environment may include a 2×2 grid of zones 220, a 2×3 grid of zones 220, a 3×3 grid of zones 220, etc. Further, in some embodiments, zones 220 may be arranged in irregular, non-rectangular grids.

Each of the listening environments described herein (e.g., passenger compartment 100 and passenger compartment 101) includes a substantially continuous volume having a relatively uniform perimeter. For example, and without limitation, passenger compartment 100 and passenger compartment 101 each have a substantially rectangular cross-section, enabling relatively uniform zones 220 to be formed along the rectangular cross-section. However, in other embodiments, the listening environment may include an irregularly-shaped cross-section. In such embodiments, the zones 220 may be determined by dividing the listening environment into zones 220 having substantially similar volumes, zones 220 having substantially similar dimensions, zones 220 having substantially similar mode densities, etc. Further, in various embodiments, the entirety of the boundary 222 between each set of zones 220 includes open space of the listening environment. For example, and without limitation, the boundary 222 between the first zone 220-1 and the second zone 220-2 shown in FIG. 2 does not include a wall or any other object that substantially interrupts the continuous volume of the passenger compartment or that segments the passenger compartment 100.

Figure 4:
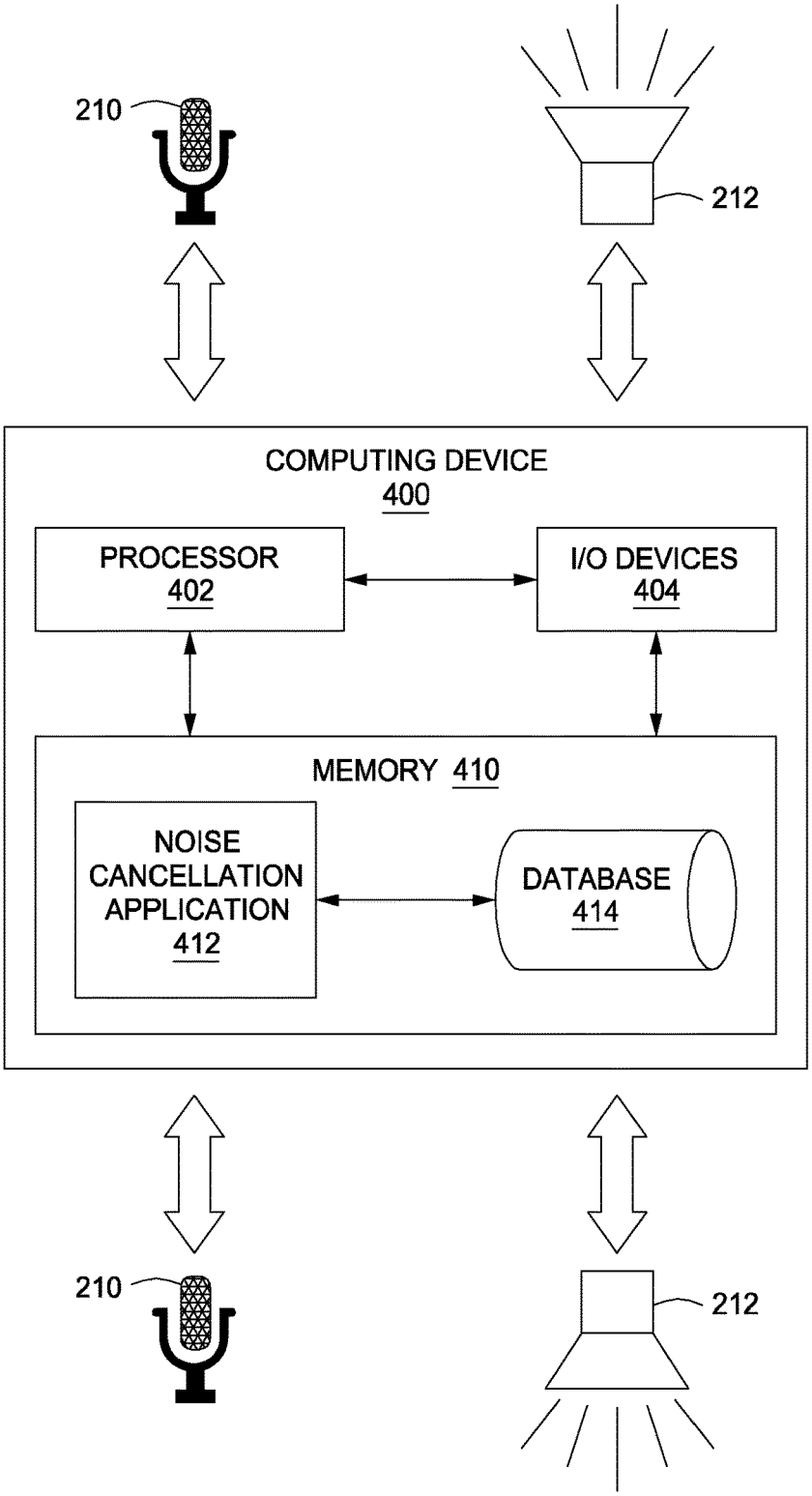
FIG. 4 illustrates a computing device configured to implement one or more aspects of a hybrid ANC system, according to various embodiments.

FIG. 4 illustrates a computing device 400 that may be implemented in conjunction with each of the ANC systems 205 of FIGS. 2 and 3, according to various embodiments. As shown, the computing device 400 includes a processor 402, input/output (I/O) devices 404, and a. memory 410. The memory 410 includes a noise cancellation application 412 configured to interact with a database 414.

The processor 402 may be any technically feasible form of processing device configured to process data to generate output, such as by executing program code. The processor 402 could be, for example, and without limitation, a central processing unit (CPU), a graphics processing unit (GPU), an application-specific integrated circuit (ASIC), a field-programmable gate array (FPGA), an analog signal processor (ASP) (e.g., an analog noise cancellation circuit), and so forth.

Memory 410 may include a memory module or a collection of memory modules. The noise cancellation application 412 within memory 410 is executed by the processor 402 to implement the overall functionality of the computing device 400 and, thus, to coordinate the operation of each ANC system 205 as a whole. For example, and without limitation, acoustic data acquired via the acoustic sensors 210 may be processed by the noise cancellation application 412 to generate noise cancellation signals that are transmitted to the speakers 212. The processing performed by the noise cancellation application 412 may include, for example, and without limitation, filtering, inverse waveform generation, pattern recognition, amplification, attenuation, and/or other types of acoustic processing.

In various embodiments, each ANC system 205 is associated with a different computing device 400 that is configured to cancel noise within the zone 220 to which the ANC system 205 is assigned. Further, in some embodiments, each computing device 400 is controlled independently of the other zones 220 and computing devices 400 associated with the other ANC systems 205 of the listening environment. For example, each ANC system 205 and associated computing device 205 could be configured to cancel noise associated with only the modal density present in the corresponding zone 220 of the listening environment (e.g., passenger compartment 100 or passenger compartment 101), reducing processing complexity in each zone 220 and enabling the hybrid ANC system 200 to effectively cancel noise with similar or lesser hardware requirements relative to conventional ANC techniques.

In some embodiments, a single ANC system 205 and computing device 400 included in the hybrid ANC system 200 may be configured to control multiple zones 220 independently of one another. For example, and without limitation, a computing device 400 configured to control a set of zones 220 independently of one another could receive acoustic data via the acoustic sensors 210 included in a first zone 202 and generate noise cancellation signals to be produced by the speakers 212 included in the first zone 220 without taking into account the acoustic data acquired via acoustic sensors 210 included in other zones 220 of the set of zones 220 and without taking into account the noise cancellation signals to be produced by speakers 212 included in other zones 220 of the set of zones 220. Accordingly, in various embodiments, a different computing device 400 is configured to control each zone 220 while, in other embodiments, one or more of the computing devices 400 may be configured to control multiple zones 220 independently from one another. Consequently, in some embodiments, the number of zones 220 included in a particular listening environment may be greater than the number of computing devices 400 implemented to control those zones 220.

In various embodiments, the listening environment (e.g., passenger compartment 100) includes a static number and configuration of zones 220. For example, and without limitation, with reference to the hybrid ANC system 200 of FIG. 2, the hybrid ANC system 200 may include a static number (i.e., two) of zones 220 having static shapes and boundaries that are not modified during operation of the hybrid ANC system 200.

In other embodiments, however, the number zones 220 into a particular listening environment (e.g., a passenger compartment of a vehicle, a room, etc.) is divided and/or the shape(s) of one or more of the zones 220 may be dynamically modified based on various criteria, such as based on acoustic data received from the acoustic sensors 210. For example, and without limitation, based on acoustic data received from the acoustic sensors 210, the noise cancellation application 412 may determine that a particular zone 220 should be divided into two or more zones 220, each associated with a different set of acoustic sensors 210 and speakers 220, and each of which is controlled independently of other zones 220 included in the listening environment. In such embodiments, the computing device 400 associated with the zone 220 would then independently control the two or more zones 220 into which that zone 220 was split.

In some embodiments, the noise cancellation application 412 could modify the size(s) and/or shape(s) of one or more zones 220 dynamically, during operation of the hybrid ANC system 200. For example, and without limitation, with reference to FIG. 2, the noise cancellation application 412 could increase the size of the first zone 220-1 and decrease the size of the second zone 220-2 by removing one or more acoustic sensors 210 and/or speakers 220 from the second zone 220-2 (and second ANC system 205-2) and assigning those acoustic sensor(s) 210 and/or speaker(s) 220 to the first zone 220-1 (and first ANC system 205-1). In another non-limiting example, the noise cancellation application 412 could add one or more additional zones 220 to a listening environment by decreasing the size of one or more existing zones 220, removing one or more acoustic sensors 210 and/or speakers 220 from the existing zone(s) 220, and assigning those acoustic sensor(s) 210 and/or speaker(s) 220 to the additional zone(s) 220. Again, however, in each example described above, after dynamic modification of the number and/or configuration of zones 220, each zone would then be controlled independently of other zones 220 included in the listening environment.

Dynamic modifications to the number and/or configuration of zones 220 within the listening environment may be performed based on the acoustic data acquired via acoustic sensors 210 in one or more of the zones 220. For example, and without limitation, the number and/or configuration of zones 220 within the listening environment could be dynamically modified during different phases or modes of vehicle operation (e.g., takeoff, landing, accelerating, braking, parking), based on the speed at which the vehicle is traveling, and/or based on the locations and/or loudness of noise produced within the passenger compartment of the vehicle. Accordingly, the number of independently controlled zones 220 may be dynamically modified to adapt the hybrid ANC system 200 to changes within the listening environment.

I/O devices 404 may include input devices, output devices, and devices capable of both receiving input and providing output. For example, and without limitation, I/O devices 404 could include wired and/or wireless communication devices that send data to and/or receive data from the acoustic sensors 210 and/or speakers 212 associated with each ANC system 205.

Generally, each computing device 400 is configured to coordinate the overall operation of an ANC system 205. In other embodiments, the computing device 400 may be coupled to, but separate from other components of an ANC system 205. In such embodiments, each ANC system 205 may include a separate processor that receives acoustic data acquired from (or proximate to) the listening environment and transmits data to the computing device 400, which may be included in a separate device, such as a personal computer, wearable device, smartphone, portable media player, etc. However, the embodiments disclosed herein contemplate any technically feasible system configured to implement the functionality of the ANC systems 205.

The noise cancellation application 412 may be configured to receive acoustic data (e.g., passenger compartment noise) associated with a corresponding zone 220 and process the acoustic data to generate noise cancellation signals. In general, the noise cancellation application 412 could generate noise cancellation signals via any type of algorithm, including, for example and without limitation, a least means squared (LMS) algorithm. The noise cancellation application 412 then outputs the noise cancellation signals to the speakers 212, for example, and without limitation, via one or more of the I/O devices 404. For example, and without limitation, the noise cancellation application 412 could output noise cancellation signals to a power amplifier that is coupled to each of the speakers 212, enabling the noise cancellation signals to be amplified for reproduction within the zone 220 of the listening environment. Further, the noise cancellation application 412 could receive additional acoustic data from the corresponding zone 220 and process the acoustic data to modify the noise cancellation signals in order to more effectively cancel out noise in the zone 220. The noise cancellation application 412 would then output the modified noise cancellation signals to the speakers 212 via the I/O device(s) 404.

The memory 410 may include one or more databases 414. For example, and without limitation, the database(s) 414 could store noise cancellation algorithms, listening environment attributes (e.g., location data, frequency response, etc.), acoustic sensor 210 attributes, speaker 212 attributes, and other types of acoustic data.

Figure 5:
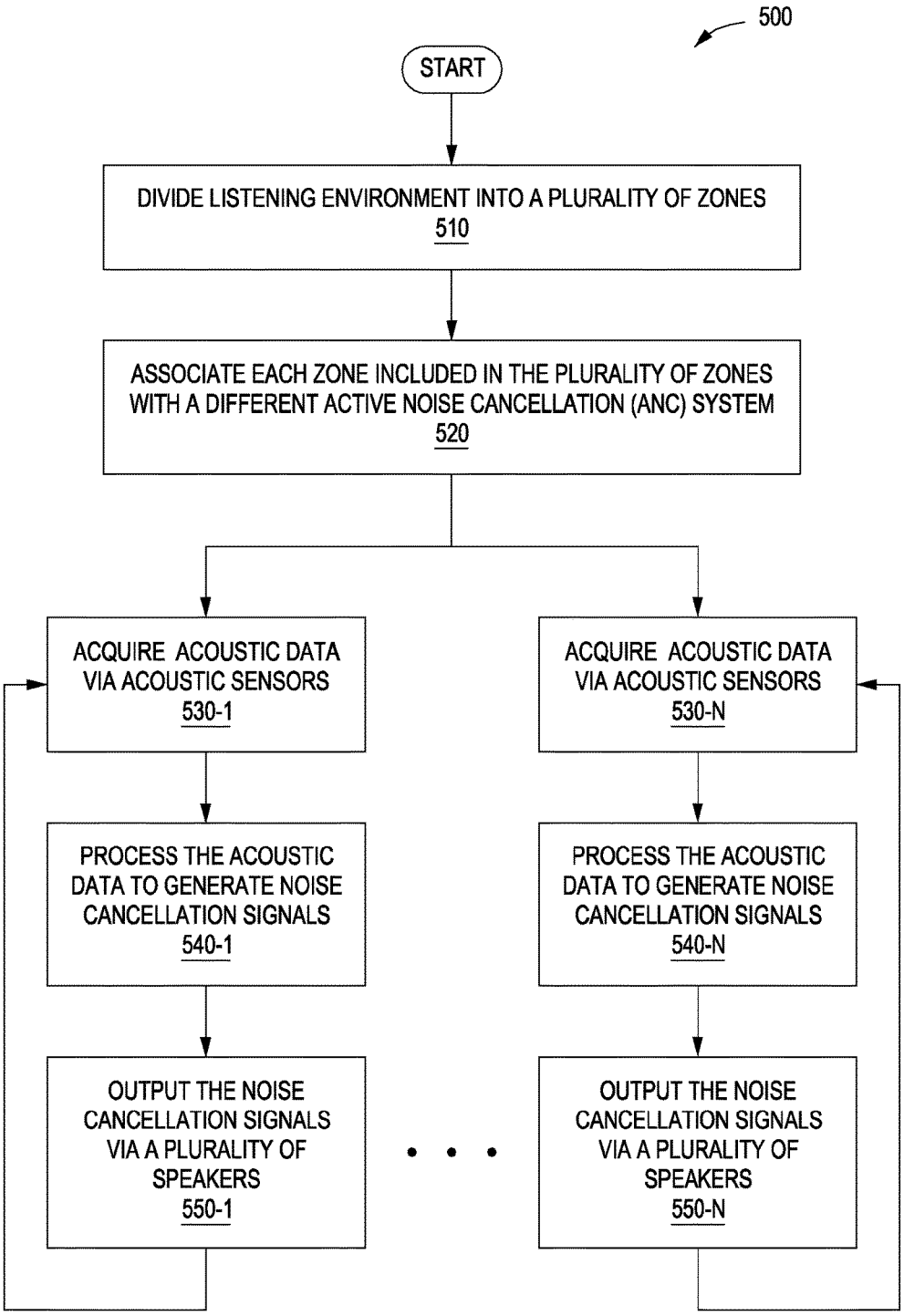
FIG. 5 is a flow diagram of method steps for reducing noise in a listening environment, according to various embodiments.
Figure 6:
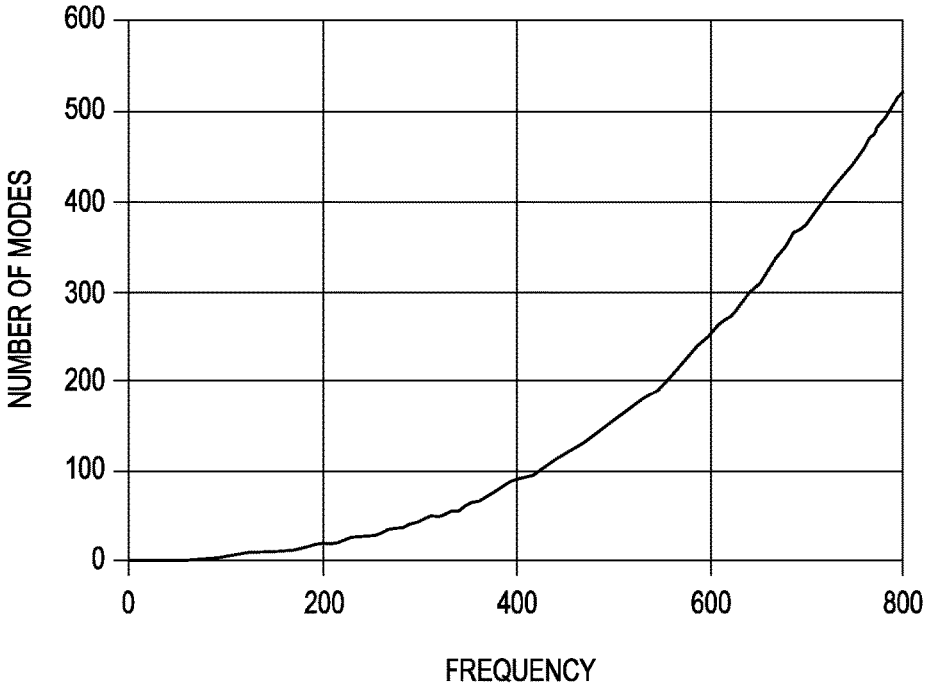
FIG. 6 illustrates a number of acoustic modes within a helicopter cabin as a function of frequency.

FIG. 5 is a flow diagram of method steps for reducing noise in a listening environment, according to various embodiments. Although the method steps are described in conjunction with the systems of FIGS. 2-4, persons skilled in the art will understand that any system configured to perform the method steps, in any order, falls within the scope of the various embodiments.

As shown, a method 500 begins at step 510, where the listening environment (e.g., passenger compartment 100, passenger compartment 101, etc.) is divided into a plurality of zones 220. In some embodiments, the listening environment is divided into a plurality of zones 220 based on the number and/or modal density within the listening environment and/or based on the number and/or modal density within each zone. For example, and without limitation, the listening environment may be divided into zones 220 that are sized such that each zone includes a specified number of modes that exceed a threshold magnitude (e.g., loudness) within a particular frequency range (e.g., 50 Hz to 1 kHz, such as about 100 Hz to about 300 Hz). Then, at step 520, each zone 220 included in the plurality of zones 220 is associated with a different ANC system 205.

Further, in some embodiments, the listening environment may be divided into a plurality of zones 220 dynamically by the noise cancellation application 412 based on, for example and without limitation, acoustic data received by the acoustic sensor(s) 210 included in one or more of the zones 220. Then, after determining the number, size, and/or shape of each zone 220, the noise cancellation application may assign a plurality of acoustic sensors 210 and a plurality of speakers 212 to each zone 220.

Next, steps 530 through 550 are performed for each zone 220 included in the plurality of zones 220. In some embodiments, steps 530 through 550 may be performed in parallel for each of the zones 220. For example, and without limitation, step 530-1 may be performed for a first zone 220-1 while step 530-N is performed for an Nth zone 220-N.

At step 530, the noise cancellation application 412 receives acoustic data via the acoustic sensors 210 associated with the corresponding zone 220. Then, at step 540, the noise cancellation application 412 processes the acoustic data (e.g., via a processor 402) to generate noise cancellation signals. At step 550, the noise cancellation signals are outputted (e.g., reproduced) via the speakers 212 in order to cancel noise within the corresponding zone 220 of the listening environment. The method 500 then returns to step 530, where the noise cancellation application 412 receives additional acoustic data via the acoustic sensors 210.

In sum, a listening environment is divided into multiple zones, where each zone includes multiple modes. A different ANC system is then assigned to reduce noise associated with the acoustic modes in each zone. A processor associated with each ANC system then processes the acoustic data recorded within the zone and generates noise cancellation signals. Finally, each processor transmits the noise cancellation signals to the speakers associated with each ANC system in order to cancel noise within the listening environment.

One advantage of the techniques described herein is that sound is more effectively cancelled within large listening environments relative to conventional ANC techniques that implement a similar number of acoustic sensors and speakers. Further, due to the synergistic effect of combining a centralized ANC approach and a decentralized ANC approach, effective noise cancellation can be achieved with lower hardware requirements, enabling the disclosed techniques to be implemented in cost-sensitive and weight-sensitive applications.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

Aspects of the present embodiments may be embodied as a system, method or computer program product. Accordingly, aspects of the present disclosure may take the form of an entirely hardware embodiment, an entirely software embodiment (including firmware, resident software, microcode, etc.) or an embodiment combining software and hardware aspects that may all generally be referred to herein as a "circuit," "module" or "system." Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Aspects of the present disclosure are described above with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, enable the implementation of the functions/acts specified in the flowchart and/or block diagram block or blocks. Such processors may be, without limitation, general purpose processors, special-purpose processors, application-specific processors, or field-programmable processors or gate arrays.

The flowchart and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While the preceding is directed to embodiments of the present disclosure, other and further embodiments of the disclosure may be devised without departing from the basic scope thereof, and the scope thereof is determined by the claims that follow.

What is claimed is:

1. A system for reducing noise in a listening environment, the system comprising:

a first active noise cancellation (ANC) system associated with a first zone of the listening environment, the first ANC system comprising:

a first plurality of acoustic sensors configured to acquire first acoustic data;

a first plurality of speakers configured to output first noise cancellation signals; and a first processor coupled to the first plurality of acoustic sensors and the first plurality of speakers and configured to:

receive the first acoustic data via the first plurality of acoustic sensors;

process the first acoustic data to generate the first noise cancellation signals; and transmit the first noise cancellation signals to the first plurality of speakers; and a second ANC system associated with a second zone of the listening environment, wherein the first zone and the second zone share a boundary within a continuous volume of the listening environment, the second ANC system comprising:

a second plurality of acoustic sensors configured to acquire second acoustic data;

a second plurality of speakers configured to output second noise cancellation signals; and a second processor coupled to the second plurality of acoustic sensors and the second plurality of speakers and configured to:

receive the second acoustic data via the second plurality of acoustic sensors;

process the second acoustic data to generate the second noise cancellation signals; and transmit the second noise cancellation signals to the second plurality of speakers, wherein the first ANC system is configured to reduce noise in the first zone of the listening environment independently of the second ANC system and each of the first zone and the second zone includes a plurality of different acoustic modes within the listening environment, wherein each acoustic mode exceeds a threshold loudness within a predetermined frequency range.

2. The system of claim 1, wherein the first processor and the second processor comprise at least one of a digital signal processor and an analog signal processor.

3. The system of claim 1, wherein the first processor is further configured to:

divide the first zone into two or more zones based on third acoustic data received via the first plurality of acoustic sensors, wherein the two or more zones share at least one boundary within the continuous volume of the listening environment;

assign each acoustic sensor included in the first plurality of acoustic sensors to a zone included in the two or more zones; and assign each of the speakers included in the first plurality of speakers to a zone included in the two or more zones.

4. The system of claim 1, wherein the entirety of the boundary between the first zone and the second zone comprises open space.

5. The system of claim 1, wherein the first plurality of speakers comprises two speakers, and the second plurality of speakers comprises two speakers.

6. The system of claim 1, wherein the listening environment comprises a passenger compartment of vehicle.

7. The system of claim 1, wherein the first noise cancellation signals and the second noise cancellation signals have a frequency from approximately 100 Hz to approximately 300 Hz.

8. The system of claim 1, wherein the first acoustic sensors and the second acoustic sensors comprise piezoelectric microphones.

9. The system of claim 1, wherein a number of acoustic modes within the listening environment is based, at least in part, on dimensions of the listening environment.

10. The system of claim 1, wherein the first zone and the second zone are each sized to include a predetermined number of acoustic modes within the listening environment.

11. A method for reducing noise in a listening environment, the method comprising:

dividing the listening environment into a plurality of zones, wherein each zone is associated with a different active noise cancellation (ANC) system, and a boundary between a first zone included in the plurality of zones and a second zone included in the plurality of zones comprises open space;

assigning a plurality of acoustic sensors and a plurality of speakers to the ANC system associated with each zone included in the plurality of zones; and for each zone included in the plurality of zones:

acquiring acoustic data via the plurality of acoustic sensors;

processing the acoustic data, via a processor, to generate noise cancellation signals; and outputting the noise cancellation signals via the plurality of speakers, wherein a first ANC system is configured to reduce noise in the first zone of the listening environment independently of a second ANC system configured to reduce noise in the second zone of the listening environment, and each of the first zone and the second zone includes a plurality of different acoustic modes within the listening environment, wherein each acoustic mode exceeds a threshold loudness within a predetermined frequency range.

12. The method of claim 11, wherein dividing the listening environment into the plurality of zones comprises processing acoustic data acquired from the listening environment to determine a number of acoustic modes within the listening environment.

13. The method of claim 11, wherein each ANC system is configured to reduce noise in the associated zone of the listening environment independently of other ANC systems included in the listening environment.

14. The method of claim 11, further comprising:

removing one or more acoustic sensors and one or more speakers from the first zone based on the acoustic data to reduce a size of the first zone; and assigning the one or more acoustic sensors and the one or more speakers to the second zone to increase a size of the second zone.

15. The method of claim 11, wherein the noise cancellation signals have a frequency from approximately 100 Hz to approximately 300 Hz.

16. The method of claim 11, wherein each zone included in the plurality of zones comprises substantially the same dimensions.

17. The method of claim 11, wherein the plurality of zones comprises three zones.

18. The method of claim 17, wherein the plurality of speakers included in each ANC system comprises two speakers.

19. The method of claim 18, wherein the listening environment comprises a passenger compartment of an aircraft.

20. A vehicle, comprising:

a passenger compartment comprising a plurality of zones, wherein a boundary between a first zone included in the plurality of zones and a second zone included in the plurality of zones comprises open space;

a plurality of active noise cancellation (ANC) systems, each ANC system associated with a different zone of the passenger compartment, and each ANC system comprising:

a plurality of acoustic sensors configured to acquire acoustic data;

a plurality of speakers configured to output noise cancellation signals; and a processor coupled to the plurality of acoustic sensors and the plurality of speakers and configured to:

receive the acoustic data via the plurality of acoustic sensors;

process the acoustic data to generate the noise cancellation signals; and transmit the noise cancellation signals to the plurality of speakers, wherein a first ANC system is configured to reduce noise in the first zone of the passenger compartment independently of a second ANC system configured to reduce noise in the second zone of the passenger compartment, and each of the first zone and the second zone includes a plurality of different acoustic modes within the listening environment, wherein each acoustic mode exceeds a threshold loudness within a predetermined frequency range.

21. The vehicle of claim 20, wherein the passenger compartment comprises at least one of an aircraft cabin, a train cabin, and an automobile cabin.

* * * * *